United States Patent [19]

Kegel

[11] 4,395,898

[45] Aug. 2, 1983

[54] ADJUSTMENT MECHANISM FOR EDGE ROLLER

[75] Inventor: Alfred Kegel, Kreuztal, Fed. Rep. of Germany

[73] Assignee: Sms-Schloemann-Siemag Aktiengesellschaft, Düsseldorf, Fed. Rep. of Germany

[21] Appl. No.: 237,675

[22] Filed: Feb. 24, 1981

[30] Foreign Application Priority Data

Mar. 4, 1980 [DE] Fed. Rep. of Germany ..... 3008203

[51] Int. Cl.[3] ..... B21B 31/26

[52] U.S. Cl. ..... 72/240; 72/248

[58] Field of Search ..... 72/237, 240, 247, 248, 72/452

[56] References Cited

U.S. PATENT DOCUMENTS 3,309,909 3/1967 Wilson ..... 72/240

3,600,925 8/1971 Field et al. ..... 72/249

3,834,214 10/1974 Kralowetz ..... 72/452

*Primary Examiner*—Francis S. Husar

*Assistant Examiner*—Jonathan L. Scherer

*Attorney, Agent, or Firm*—Karl F. Ross; Herbert Dubno

[57] ABSTRACT

An edge roller assembly has a fixed guide member on which a support block is displaceable in a predetermined adjustment direction so as to move an edge roller rotatable on the block about an axis transverse to this direction. A threaded pin spindle extends generally parallel to the direction and bears on the block and is threaded into a nut in an adjustment member. A pair of links each have an inner end pivoted on the guide member and an outer end pivoted by means of a respective eccentric pin on the adjustment member. Thus rotation of these pins can relatively displace the adjustment and guide members, so as to move the rollers carried by the support blocks toward one another even while engaging a workpiece.

9 Claims, 4 Drawing Figures

ADJUSTMENT MECHANISM FOR EDGE ROLLER

FIELD OF THE INVENTION

The present invention relates to an edge roller such as used to square the edge of a metal band being produced in a hot-strip mill. More particularly this invention concerns an adjustment mechanism for displacing such an edge roller perpendicular to its axis of rotation.

BACKGROUND OF THE INVENTION

In a hot-strip mill it is standard practice to square the edges of the strip being produced by means of an edge-roller assembly having a pair of edge rollers rotatable about parallel vertical axis that flank the horizontal plane of the strip adjacent a standard roller stand having a pair of vertically offset horizontal rollers rotatable about horizontal axes. The edge rollers engage the edge of the strip being produced to square it.

Normally such edge rollers are journaled in support blocks displaceable horizontally relative to heavy-duty guides which are frequently secured to the stands of the adjacent roll assembly. Each of the support blocks is associated with a respective heavy-duty spindle that is threaded in a nut carried fixedly on the guide and that axially bears against the respective support block. An appropriate drive is provided for rotating this spindle, screwing it in the nut, and thereby displacing the respective roller and support block relative to the guide. Normally such a spindle has a screw thread which is made as flat as possible consonant with a usable adjustment speed. The horizontal spacing between the two edge rollers is normally set before the workpiece engages them.

In a reversing-strip mill it would, however, be advantageous to be able to reset the spacing between the edge rollers between consecutive passes of the workpiece. Such resetting could compensate for the normal thermal contraction of the workpiece as it cools.

The above-described spindle arrangement cannot be used to reset the edge rollers while they engage the workpiece. Dimensioning the spindle large enough and the thread flat enough to be able to exert the necessary large amount of force on the workpiece while it is engaged between the edge rollers would create an impractical bulky assembly. In addition such an assembly would inherently have an extremely slow adjustment speed so that it would take quite some time to bring the edge rollers to the desired spacing when roller spacing is changed.

Accordingly it has been standard practice to simply set the edge rollers at a spacing which is a compromise between the spacing appropriate for the first pass and the spacing appropriate for the second pass. The result is a workpiece whose edges are not perfectly squared, and where the edges are frequently subjected to excessive deformation on the first pass.

OBJECTS OF THE INVENTION

It is therefore an object of the present invention to provide an improved edge roller assembly.

Another object is to provide an improved adjustment mechanism for such an assembly.

Yet another object is to provide such an adjustment mechanism which can easily be operated when a workpiece is engaged between the rollers of the assembly, yet which still can operate at high speed.

A further object is to provide an adjustment assembly which adds only nominal cost to an edge roller assembly.

SUMMARY OF THE INVENTION

These objects are attained according to the instant invention in an edge-roller assembly of the above-described type, but wherein the spindle is threaded into a nut carried on an adjustment member separate from the fixed guide member of the support block. At least one link has an inner link end and an outer link end. One of these link ends is pivoted about a link axis transverse to the displacement direction of the support block on one of the members. An eccentric pin has a cylindrical eccentric surface centered on an eccentric axis parallel to the link axis and engaging the other of the link ends and a cylindrical noneccentric surface centered on a noneccentric axis parallel to and offset from the eccentric axis and engaging the other of the members. This pin is rotatable about the noneccentric axis in the other member. Means is provided for rotating this pin about the noneccentric axis relative to the other member and thereby relatively displacing the guide and roller in the displacement direction of the roller.

With the system according to the instant invention, therefore, the threaded spindle and its respective drive means are used solely to position the edge rollers before the workpiece is first passed through them. After the first pass the above-described eccentric system is used to displace the rollers inwardly for the second pass. This eccentric adjustment mechanism has, admittedly, only a very limited stroke. Nonetheless this stroke is sufficient for the small adjustment needed between consecutive passes of the workpiece. In addition the amount of force that can be brought to bear on the support block for the roller by means of such an eccentric arrangement is enormous, so that adjustment while engaging a workpiece is no problem. Normally the eccentric mechanism is set so that the guide members and adjustment members are as far apart as possible before the initial setting is done by means of the spindle. Thereafter the fine adjustment can be carried out, even during a rolling pass, by the above-described eccentric arrangement. Since the spindle is only used for displacing the support block of the roller while the respective roller is out of engagement with the workpiece, it can have a relatively steep thread for fast as possible coarse adjustment.

According to further features of this invention the adjustment-member is a sleeve axially displaceable relative to the spindle axis in the guide member and having at an outer adjustment-member end remote from the support block a pair of laterally projecting lugs each engaging a respective eccentric surface of a respective eccentric pin. Two such links are also provided, one for each of the eccentric pins, and the inner ends of the links are pivoted on the guide member. According to this invention coupling means is provided connecting the two eccentric pins together for joint rotation.

In accordance with this invention one such support block with the respective spindle, nut, adjustment member, a pair of links, and a pair of eccentrics is provided for each end of each of the edge rollers. Thus, four eccentric-pin assemblies are provided. The drive means is connected to all four of these adjustment mechanisms for simultaneous and synchronous actuation of them.

According to further features of this invention the adjustment-member is constituted as a sleeve surrounding the spindle and having a front end turned toward the support block and provided with the nut in which the spindle is screwed. At its rear end the sleeve is formed with two pairs of oppositely outwardly projecting lugs. Two links are provided flanking the sleeve constituting the adjustment member. Each such link has an inner end pivoted on the guide member and an outer end pivoted via a respective eccentric pin on the adjustment member at the respective pair of lugs.

With such an arrangement according to this invention means is provided for coupling together the two eccentric pins for joint synchronous rotation so that the support block on which their inner ends are pivoted moves squarely within the guide member. This coupling means can constitute a simple universal joint.

According to further features of this invention, worm-gear systems are provided for rotating the eccentric pins. To this end each eccentric pin carries a pinion meshing with the respective worm. Obviously these worms rotate about axes perpendicular to and spaced from the respective noneccentric axes. The two worms can be connected together by means of a flexible coupling to insure joint synchronous rotation of the two eccentric pins.

SPECIFIC DESCRIPTION

Figure 1:
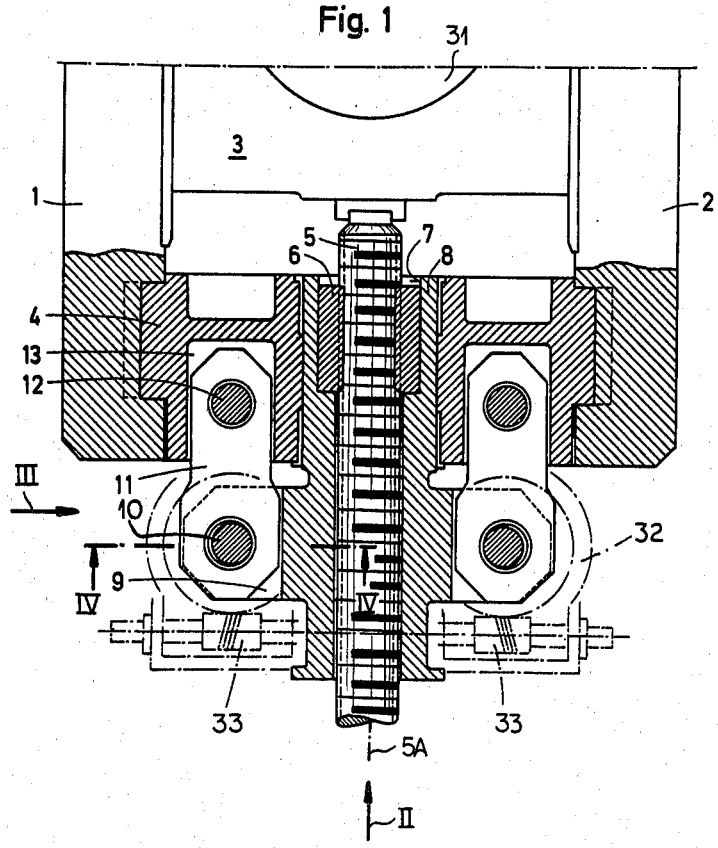
FIG. 1 is a top view partly in horizontal section through an assembly according to this invention.
Figure 2:
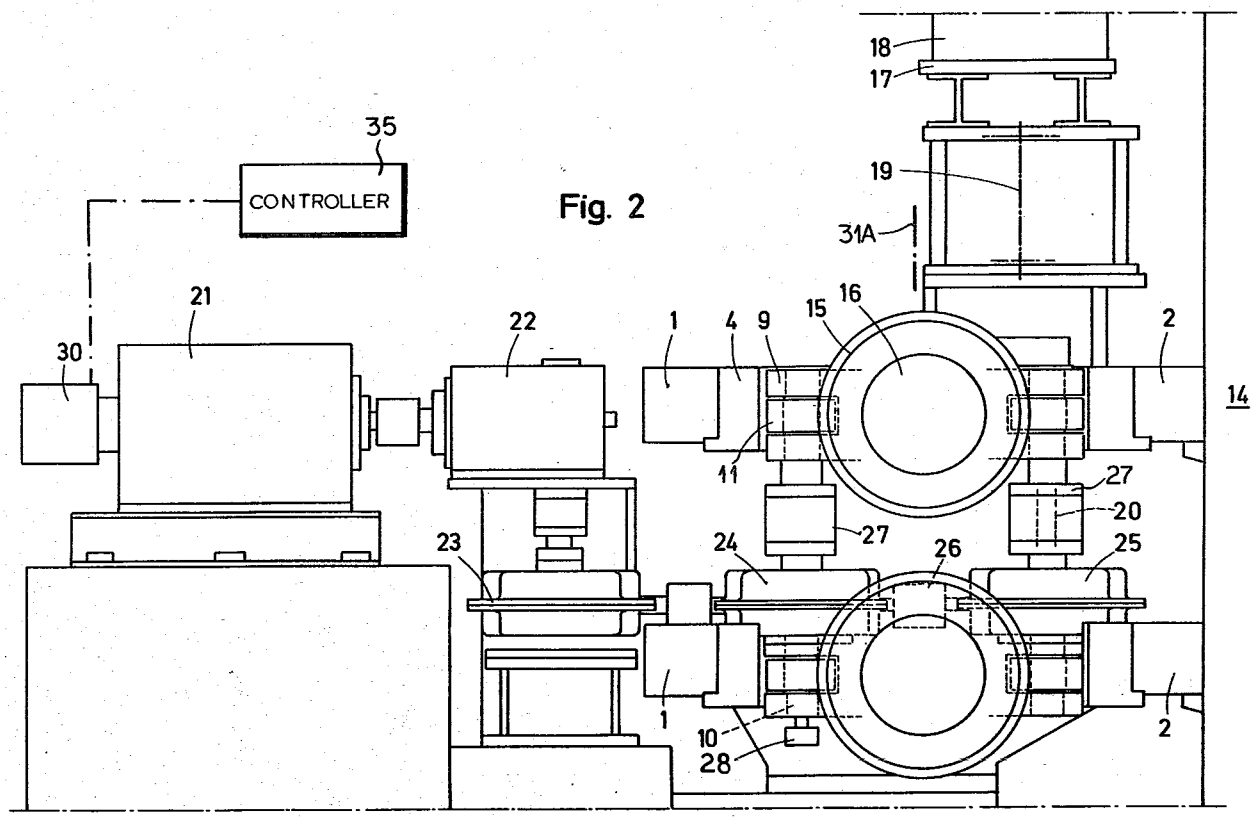
FIG. 2 is a side view taken in the direction of arrow II of FIG. 1.

As seen in FIGS. 1 and 2 according to this invention an edge roller has at one end a stub shaft 31 journaled in a support block 3 slideable in guides 1 and 2 secured together at their outer ends by a crosspiece 4. The guides 2 as seen in FIG. 2 are secured to the frame 14 of a standard rolling frame. Thus the stub shaft 31 is centered on an upright axis indicated at 31A in FIG. 2.

A heavy-duty threaded spindle 5 centered on an axis 5A has one end connected via an axial-thrust bearing to the slide or support block 3 and is threaded in a heavy-duty nut 6 received within an appropriately shaped polygonal recess 7 formed at the inner end of an adjustment-member sleeve 8 also centered on the axis 5A. Assuming this adjustment-member sleeve 8 is fixed relative to the frame member 4, rotation of this spindle 5 about its axis 5A will obviously displace the support block 3 in the respective stub shaft 31 along the axis 31A.

It should be noted that the roller has two such stub shafts 31, one vertically above the other along the axis 31A. Each such stub shaft 31 is journaled in a respective support block 3 carried between a respective pair of guide members 1 and 2 flanked by a respective crosspiece 4. Each such crosspiece 4 is in turn associated with the respective sleeve 8 carrying a respective nut 6 in which is threaded a respective spindle 5. The upper and lower adjustment mechanisms are substantially identical.

Figure 4:
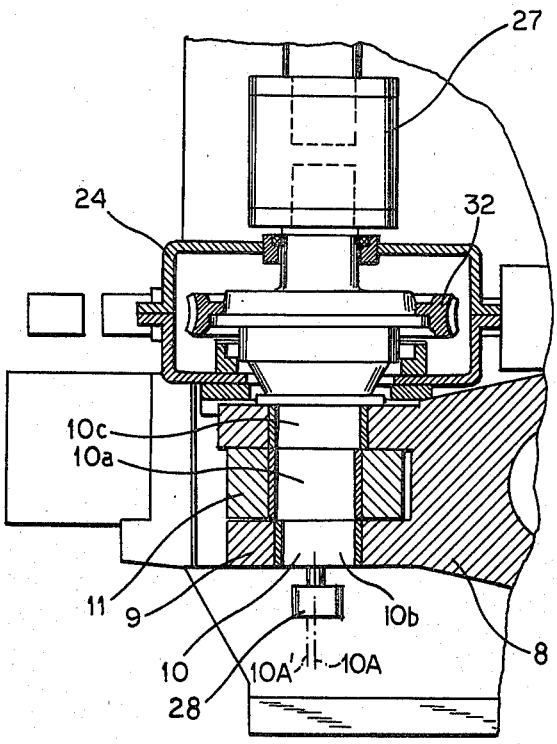
FIG. 4 is a section taken along line IV—IV of FIG. 1.

According to this invention each adjustment-member sleeve 8 is formed as shown in FIG. 1 on its outer end with two pairs of outwardly projecting lugs 9. Engaging through each pair of lugs 9 is as better shown in FIG. 4 an eccentric pin 10 having an eccentric surface 10*a*, a lower noneccentric surface 10*b* and an upper noneccentric surface 10*c*. The surface 10*a* is centered on an axis 10A′ and the surfaces 10*b* and 10*c* on a noneccentric axis 10A. The lugs 9 are formed with appropriate bores snugly journaling the respective noneccentric surfaces 10*b* and 10*c*. In addition the surface 10*c* is larger in diameter from the surface 10*b* by a difference equal exactly to the spacing between the axes 10A and 10A′, so that each pin 10 can be inserted downwardly through its respective pair of lugs 9 with ease.

Links 11 best shown in FIG. 1 have outer ends in which the eccentric surfaces 10*a* of the respective pins 10 are snugly journaled and inner ends which are journaled on pins 12 traversing recesses 13 formed in the endpiece 4 and receiving the inner ends of the links 11.

Figure 3:
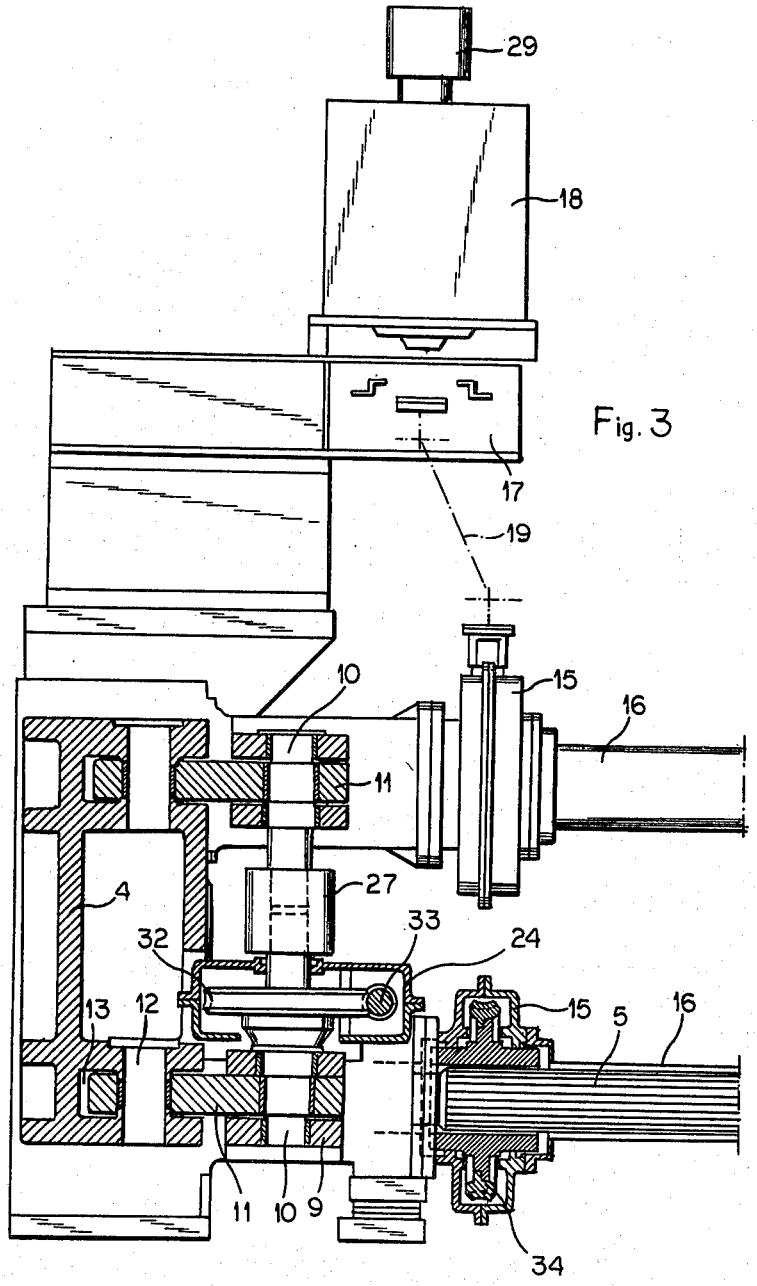
FIG. 3 is a side view partly in section taken in the direction of arrow III of FIG. 1.

The upper and lower spindles 5 each have as seen in FIG. 3 splined rear portions axially slideable in pinion gears 34 meshing with respective unillustrated worms connected together vertically by a flexible coupling as shown schematically in FIG. 2 at 20. Housings 15 surround each of these worm-gear drives having the pinion 34 and tubular sleeves 16 surround the rearwardly projecting portion of each of the spindles 5. A support 17 on the frame of the assembly carries an electric motor 18 connected via a flexible shaft shown schematically at 19 to the uppermost worm gear in the upper housing 15 for adjustment of the upper spindle 5 and through the flexible coupling 20 (FIG. 2) to the worm gear for the lower pinion 34. Thus the two spindles 5 will be rotated synchronously in the same direction.

In addition the lower eccentric pins 10 each have an upward extension provided with a respective pinion 32 meshing with a respective worm gear 33. A motor 21 provided to the side of the machine as shown in FIG. 2 is connected through an angle drive 22 to a worm-gear stepdown transmission 23 and therethrough to the worm gear 33 of the lower eccentric pin 10 and then through a flexible coupling 26 to the other worm gear. The one worm transmission of the one lower eccentric pin is held in a housing 24 and the other in a housing 25. Each of the lower eccentric pins 10 is connected via a respective flexible coupling 27 to the respective upper eccentric pin 10 for joint and synchronous rotation. Thus, the motor 21 can rotate all four of the eccentric pins 10 simultaneously. The motor 18 is associated with a position detector 29 connected to a controller 35. Similarly, the motor 21 has a position detector 30 connected to the controller 35 and one of the lower eccentric pins 10 is associated with a similar such position detector 28.

Before setting up the machine according to this invention, the controller 35 normally operates the motor 21 to move the adjustment-member sleeve 8 back, that is downwardly in FIG. 1, as far as possible relative to the support blocks 3. Then the motor 18 is operated to move the support blocks 3 into the desired position for the desired spacing between the rollers having the stud shaft 31.

After a first pass in the forward direction a workpiece is passed back between the edge rollers having the stub shafts 31 which must therefore be reset to be somewhat closer together to compensate for thermal contraction due to cooling. The motor 21 is therefore operated by the controller 35 to rotate all of the eccentric pins 10 so as to move the support block 3, spindle 5, and sleeve 8 somewhat inwardly, that is up in FIG. 1, to the desired position as determined by the position detectors 20–30. The transmission 22 is of the bevel-gear type with a stepdown of 1:8. In addition the transmissions in the housings 24 and 25 have stepdowns of between 1:33 and 1:31. As a result an enormous amount of force can be brought to bear by the motor 21. At the same time operation speed can be relatively great so that the displacement is as fast as 2 mm/sec. Using an eccentricity between the axes 10A and 10A' of 7.5 millimeters it is possible to obtain a stroke of 15 millimeters between the opposite end frames, with a total of 30 mm possible. Hence even under load it is possible to move the rollers having stub shafts 31 inwardly with enormous force and at considerable speed. During such adjustment the spindles 5 are not rotated at all.

I claim:

1. An edge roller assembly comprising:

a fixed guide member;

a support block displaceable in a predetermined adjustment direction on said guide member;

an edge roller supported on said block and rotatable thereon about a roller axis transverse to said direction;

a threaded spindle centered on a spindle axis generally parallel to said direction and bearing in said direction on said block;

an adjustment member provided with a nut in which said spindle is threaded, whereby rotary pivoting of said spindle about said spindle axis relatively axially displaces said adjustment member and said roller;

at least one link having an inner link end and an outer link end, one of said link ends being pivoted about a link axis transverse to said direction on one of said members;

an eccentric pin having a cylindrical eccentric surface centered on an eccentric axis parallel to said link axis and pivoted on the other of said link ends and a cylindrical noneccentric surface centered on a noneccentric axis parallel to and offset from said eccentric axis and engaging the other of said members, said pin being rotatable about said noneccentric axis in said other member; and means including a drive motor and a worm-type stepdown transmission connected between said motor and said pin for rotating said pin about said noneccentric axis relative to said other member and thereby relatively displacing said guide member and roller in said direction.

2. The assembly defined in claim 1 wherein said adjustment member is a sleeve at least partially surrounding said spindle.

3. The assembly defined in claim 2 wherein said adjustment member is elongated along said spindle axis and has a front end relatively close to said block and provided with said nut and a rear end provided with a pair of laterally oppositely projecting lugs, said assembly including two such eccentric pins having eccentric surfaces engaging said lugs.

4. The assembly defined in claim 3, further comprising coupling means connecting together said eccentric pins for joint synchronous rotation.

5. The assembly defined in claim 1 wherein said motor is electric.

6. The assembly defined in claim 1, further comprising means including another drive motor for rotating said spindle about said spindle axis relative to said members.

7. The assembly defined in claim 3 wherein said rear end is provided with two pairs of such laterally oppositely projecting lugs each engaging a respective eccentric pin, each such pin having two such noneccentric surfaces concentric with each other and flanking the respective eccentric surface, each outer link end being engaged between the lugs of a respective pair of said lugs.

8. The assembly defined in claim 4 wherein said pair of noneccentric surfaces of each pin includes a large-diameter noneccentric surface and a small-diameter noneccentric surface, the difference in diameters of said noneccentric surfaces being at least equal to the distance between said eccentric and noneccentric axes.

9. The assembly defined in claim 1 wherein said transmission includes a pinion centered on said noneccentric axis and mounted on said pin and a worm gear meshing with said pinion, said drive motor being connected to said worm gear.

* * * * *